US008616252B2

(12) United States Patent
Clever et al.

(10) Patent No.: US 8,616,252 B2
(45) Date of Patent: Dec. 31, 2013

(54) FUEL DISPENSING NOZZLE WITH ATTITUDE SENSING DEVICE

(75) Inventors: Bryan William Clever, Liberty Township, OH (US); Robert William Munch, Germantown, OH (US)

(73) Assignee: OPW Fueling Components Inc., Hamilton, OH (US)

( * ) Notice: Subject to any disclaimer, the term of this patent is extended or adjusted under 35 U.S.C. 154(b) by 403 days.

(21) Appl. No.: 12/954,157

(22) Filed: Nov. 24, 2010

(65) Prior Publication Data

US 2012/0125478 A1 May 24, 2012

(51) Int. Cl.
*B65B 1/04* (2006.01)
*B65D 47/06* (2006.01)

(52) U.S. Cl.
CPC ..... *B65D 47/06* (2013.01)
USPC ..... 141/309; 141/59; 141/206

(58) Field of Classification Search
USPC ..... 141/59, 206, 308, 309
See application file for complete search history.

(56) References Cited

U.S. PATENT DOCUMENTS

| | | | | |
|---|---|---|---|---|
| 732,494 | A | 6/1903 | Allen | |
| 1,998,221 | A | 4/1935 | Conklin | |
| 2,582,195 | A | 1/1952 | Duerr | |
| 2,874,735 | A * | 2/1959 | Boone | 141/208 |
| 3,085,600 | A | 4/1963 | Briede | |
| 3,323,560 | A * | 6/1967 | Ehlers | 141/208 |
| 3,521,679 | A | 7/1970 | Copony | |
| 4,058,149 | A * | 11/1977 | Hansel | 141/301 |
| 4,453,578 | A | 6/1984 | Wilder | |
| 4,559,982 | A | 12/1985 | Fink, Jr. | |
| 4,809,753 | A * | 3/1989 | Fink, Jr. | 141/206 |
| 5,325,896 | A * | 7/1994 | Koch et al. | 141/59 |
| 5,327,944 | A | 7/1994 | Healy | |
| 5,379,811 | A * | 1/1995 | Dotson et al. | 141/206 |
| 5,549,132 | A * | 8/1996 | Butterfield et al. | 137/270 |
| 5,562,133 | A * | 10/1996 | Mitchell | 141/206 |
| 5,687,778 | A * | 11/1997 | Harris | 141/59 |
| 6,336,479 | B1 * | 1/2002 | Nanaji | 141/4 |
| 7,134,580 | B2 * | 11/2006 | Garrison et al. | 222/566 |

OTHER PUBLICATIONS

PCT, International Search Report and Written Opinion, International Application No. PCT/US2011/059848 (Mar. 27, 2012).

* cited by examiner

*Primary Examiner* — Timothy L Maust
(74) *Attorney, Agent, or Firm* — Thompson Hine L.L.P.

(57) ABSTRACT

A nozzle including a dispensing path configured such that fluid is dispensable therethrough and into a vessel, and a sensing path in which a negative pressure is generated when fluid flows through the dispensing path. The nozzle further includes an attitude sensing device configured to sense an attitude of the nozzle. The attitude sensing device is in fluid communication with the sensing path and includes a ball received in a track. The track includes a generally spherical portion configured to receive the ball therein to generally block the sensing path when the nozzle is raised to a sufficient angle. The spherical portion has a radius generally corresponding to a radius of the ball.

26 Claims, 8 Drawing Sheets

FUEL DISPENSING NOZZLE WITH ATTITUDE SENSING DEVICE

The present invention is directed to a fuel dispensing nozzle, and more particularly, to a fuel dispensing nozzle with an attitude sensing device.

BACKGROUND

Fuel dispensers are widely utilized to dispense fuels, such as gasoline, diesel, natural gas, biofuels, blended fuels, propane, oil, ethanol or the like, into the fuel tank of a vehicle. Such dispensers typically include a nozzle that is insertable into the fuel tank of the vehicle. The nozzle may include an attitude sensing device that is configured to cause the nozzle to shut off when the nozzle is oriented in a predetermined configuration (i.e., typically when the nozzle is positioned at a particular angle relative to horizontal). However, existing attitude sensing devices are often not triggered at consistent angles and therefore do not provide repeatable, predictable performance.

SUMMARY

In one embodiment the present invention is a nozzle with an attitude device which provides repeatable and predictable performance. More particularly, in one embodiment the invention is a nozzle including a dispensing path configured such that fluid is dispensable therethrough and into a vessel, and a sensing path in which a negative pressure is generated when fluid flows through the dispensing path. The nozzle further includes an attitude sensing device configured to sense an attitude of the nozzle. The attitude sensing device is in fluid communication with the sensing path and includes a ball received in a track. The track includes a generally spherical portion configured to receive the ball therein to generally block the sensing path when the nozzle is raised to a sufficient angle. The spherical portion has a radius generally corresponding to a radius of the ball.

DETAILED DESCRIPTION

Figures 1, 1A:
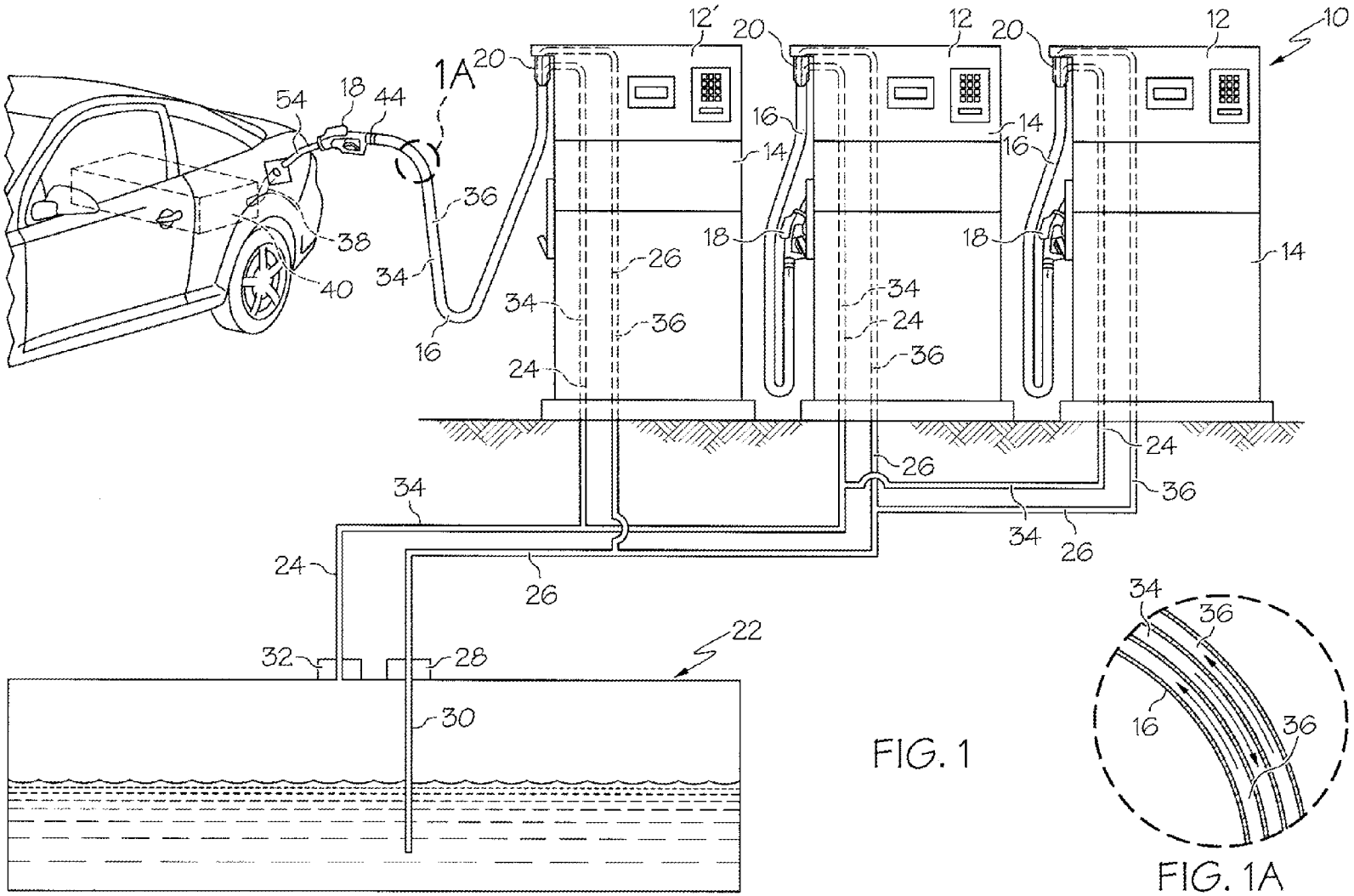
FIG. 1 is a schematic representation of a refilling system utilizing a plurality of dispensers.
FIG. 1A is a detail section of the area indicated in FIG. 1.

FIG. 1 is a schematic representation of a refilling system 10 including a plurality of dispensers 12. Each dispenser 12 includes a dispenser body 14, a hose 16 coupled to the dispenser body 14, and a nozzle 18 positioned at the distal end of the hose 16. Each hose 16 may be generally flexible and pliable to allow the hose 16 and nozzle 18 to be positioned in a convenient refilling position as desired by the user/operator.

Each dispenser 12 is in fluid communication with a fuel/fluid storage tank 22 via a fluid conduit 26 that extends from each dispenser 12 to the storage tank 22. The storage tank 22 includes or is coupled to a fuel pump 28 which is configured to draw fluid out of the storage tank 22 via a pipe 30. During refilling, as shown by the in-use dispenser 12' of FIG. 1, the nozzle 18 is inserted into a fill pipe 38 of a vehicle fuel tank 40. The fuel pump 28 is then activated to pump fuel from the storage tank 22 to the nozzle 18 and into the vehicle fuel tank 40 via a fuel path or dispensing path 36 of the system 10.

In some cases, it is desired to capture vapors expelled from the fuel tank during refilling, and route the vapors to the tank 22. In this case, a vapor path 34 extends from the nozzle 18, through the hose 16 and a vapor conduit 24 to the ullage space of the tank 22. For example, as shown in FIG. 1A, in one embodiment the vapor path 34 of the hose 16 is received within, and generally coaxial with, an outer fluid path 36 of the hose 16. A vapor pump or suction source 32 may be in fluid communication with the vapor path 34 to aid in the recovery of vapor expelled from the vehicle fuel tank 40 and route the captured vapors to the ullage space of the tank 22. Alternately, in some cases the vapor pump 32 may be omitted and the vapors may be urged through the vapor path 34 and to the tank 22 by the pressure of fluid entering the vehicle fuel tank 40.

It should be understood that the arrangement of pumps 28, 32 and storage tank 22 can be varied from that shown in FIG. 1. In one particular example, the fuel pump 28 and/or vapor pump 32 (if utilized) can instead be positioned at each associated dispenser 12 in a so-called "suction" system, instead of the so-called pressure system shown in FIG. 1. Moreover, it should be understood that the system 10 disclosed herein can be utilized to store/dispense any of a wide variety of fluids, liquids or fuels, including but not limited to petroleum-based fuels, such as gasoline, diesel, natural gas, biofuels, blended fuels, propane, oil or the like, or ethanol the like.

Figure 2:
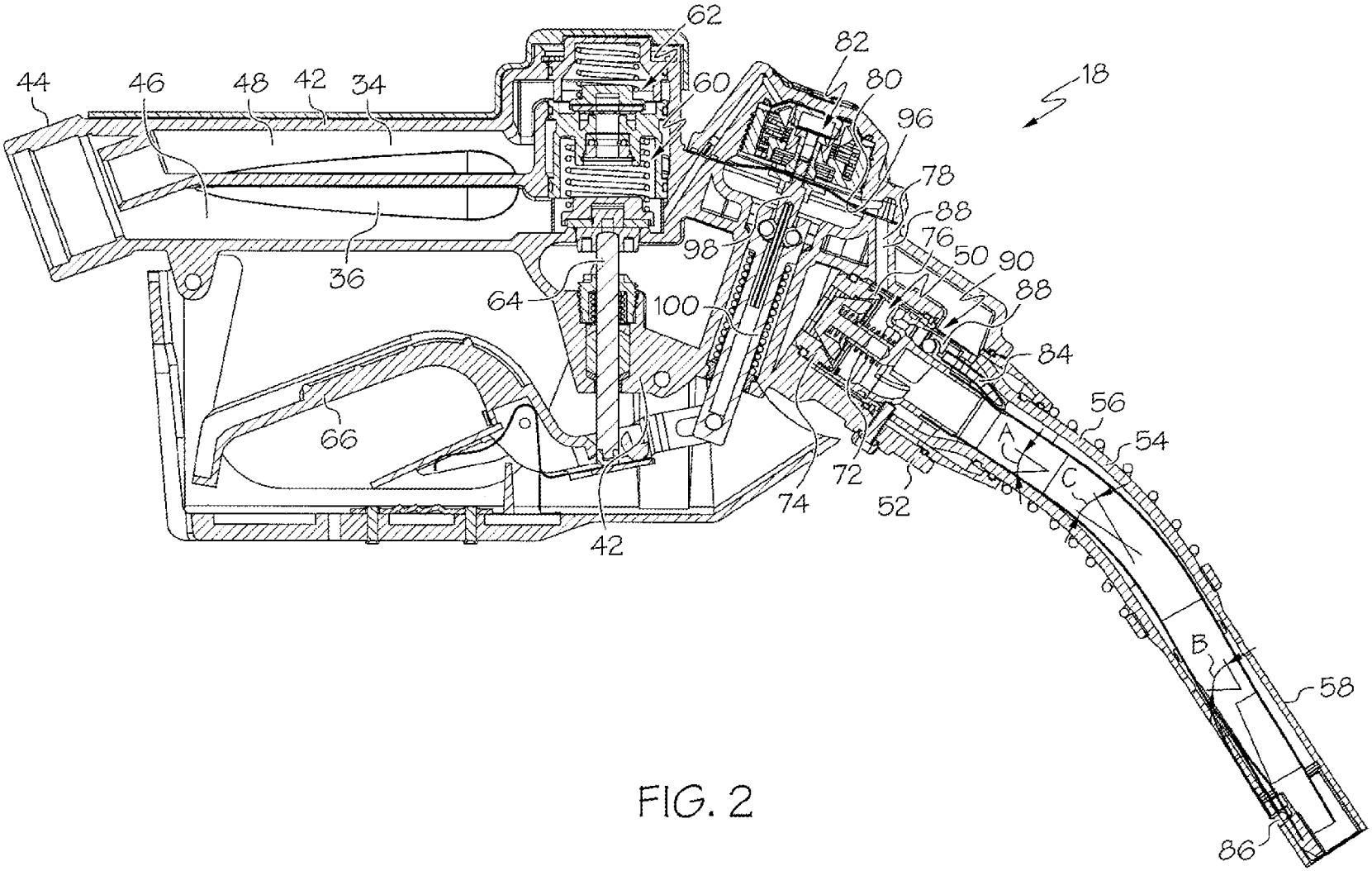
FIG. 2 is a side cross section of a nozzle of the system of FIG. 1.

As best shown in FIG. 2, the nozzle 18 may include a nozzle body 42 having a generally cylindrical inlet 44 leading directly to a main fluid path 46 and a main vapor path 48. The inlet 44 is configured to be connected to an associated hose 16, such as by threaded attachment. The nozzle body 42 has an outlet 50 which receives a spout adapter 52 therein. The spout adapter 52, in turn, threadably receives a spout 54 therein that is configured to dispense liquid flowing therethrough. The spout has a base or straight portion 56 and an end portion 58 that is angled downwardly relative to the base portion 56. In some cases, the nozzle 18 may include a vapor recovery boot (not shown) coupled to the spout 54 and/or spout adaptor 52, extending coaxially thereabout to trap vapors and provide an inlet to the vapor path 34.

When the nozzle body 42 is oriented generally horizontally (i.e. the main fluid path 46 and/or main vapor path 48 are oriented generally horizontally, as shown in FIG. 2), the base portion 56 is arranged at an angle A with respect to the horizontal/nozzle body 42. The angle A can, in one case, range between about 20° and about 50°; and be about 35° in one embodiment. The end portion 58 can be arranged at an angle B with respect to the horizontal/nozzle body 42. The angle B can, in one case, range between about 40° and about 70°, and be about 55° in one embodiment. The end portion 58 can form an angle C relative to the base portion 56, which can be between about 15° and about 30°, and about 22.5° in one case.

A main fluid valve 60 is positioned in the fluid path 36 to control the flow of liquid therethrough and through the nozzle 18. Similarly, when a vapor recovery path 34 is utilized, a main vapor valve 62 is positioned in the vapor path 34 to control the flow of vapor therethrough and through the nozzle 18. Both the main fluid valve 60 and main vapor valve 62 are carried on, or operatively coupled to, a main valve stem 64. The bottom of the main fluid valve stem 64 is positioned above or operatively coupled to a lever 66 which can be manually raised or actuated by the user. In operation, when the user raises the lever 66 and refilling conditions are appropriate, the lever 66 engages and raises the valve stem 64, thereby opening the main fluid valve 60 and main vapor valve 62.

Figure 3:
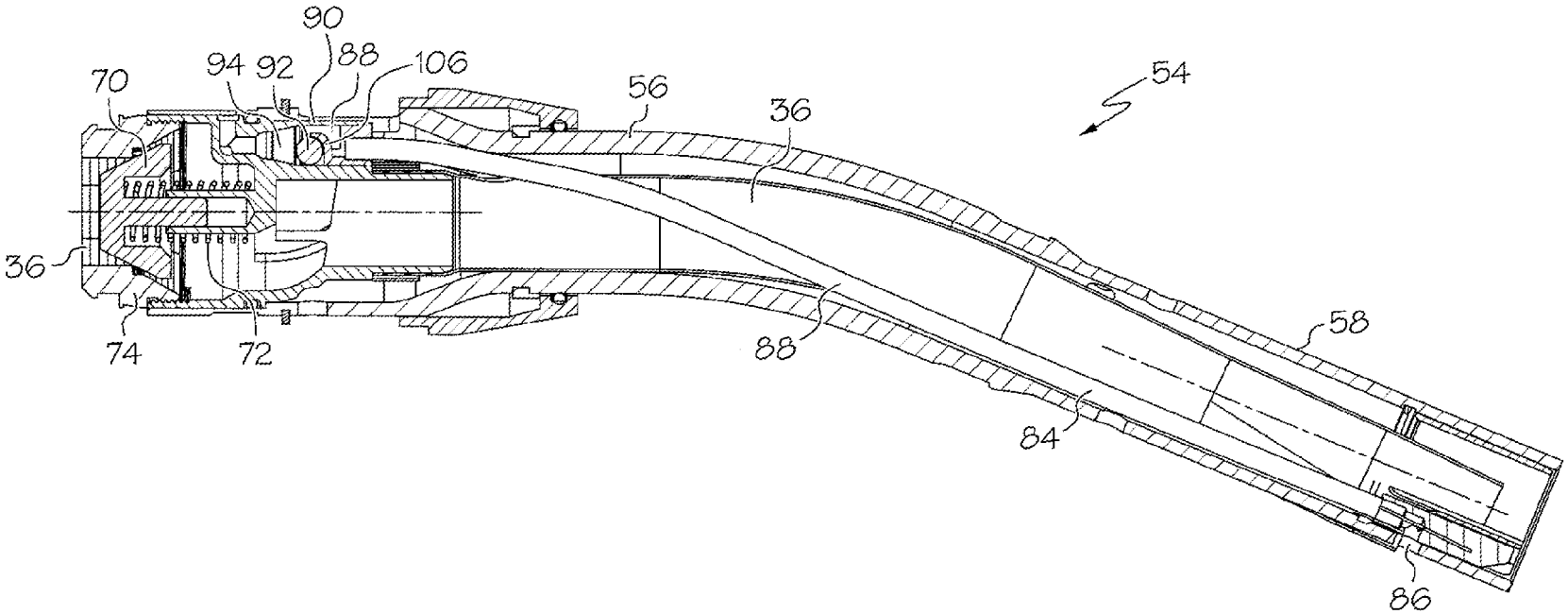
FIG. 3 is a detail view of the spout and spout adapter of the nozzle of FIG. 2.

As best shown in FIG. 3, a venturi poppet 70 is mounted in the spout 54/spout adaptor 52 and positioned in the fluid path 36. A venturi poppet spring 72 engages the venturi poppet 70 and urges the venturi poppet 70 to a closed position wherein the venturi poppet 70 engages an annular seating ring 74. When fluid of a sufficient pressure is present in the fluid path 36 (i.e., during dispensing operations), the force of the venturi poppet spring 72 is overcome by the dispensed fluid and the venturi poppet 70 is moved to its open position, away from the seating ring 74.

When the venturi poppet 70 is open and liquid flows between the venturi poppet 70 and the seating ring 74, a venturi effect is created in a plurality of radially-extending passages (not shown) extending through the seating ring 74 and communicating with an annular chamber 76 (FIG. 2) formed between the spout adaptor 52, the nozzle body 42 and the seating ring 74. The annular chamber 76 is in fluid communication with a venturi passage 78 formed in the nozzle body 42 which is, in turn, in fluid communication with a central or venturi chamber 80 of a no-pressure, no-fill valve or shut-off valve/device 82.

The annular chamber 76 is also in fluid communication with a tube 84 (FIG. 3) positioned within the spout 54. The tube 84 terminates at, and is in fluid communication with, an opening 86 positioned on the underside of the spout 54 at or near the distal end thereof. The tube 84, annular chamber 76, venturi passage 78 and other portions of the nozzle 18 exposed to the venturi pressure, form or define a sensing path 88 which is fluidly isolated from the fluid flow path 36.

When the venturi poppet 70 is open and fluid flows through the fluid path 36, the venturi or negative pressure in the annular chamber 76 and sensing path 88 draws air through the opening 86 and tube 84, thereby dissipating the negative pressure. This venturi effect is described in greater detail in U.S. Pat. No. 3,085,600 to Briede, the entire contents of which are incorporated herein. However, it should be understood that a venturi or negative pressure in the sensing path 88 can be generated by any of a wide variety of mechanisms or devices, and the attitude sensing device disclosed herein is not limited to use with any particular venturi or negative pressure system.

An attitude sensing device, generally designated 90, is positioned in, or in fluid communication with, the sensing path 88. In particular, in the illustrated embodiment, the attitude sensing device 90 is positioned at an upstream end (with respect to the flow of vapors/fluid therethrough) of the tube 84 and in the base portion 56 of the spout 54 adjacent to the venturi poppet 70. Positioning the attitude device 90 in this manner, and away from the tip of the spout 54, protects the attitude sensing device 90 and avoids direct exposure of the attitude sensing device 90 to liquids.

Figure 4:
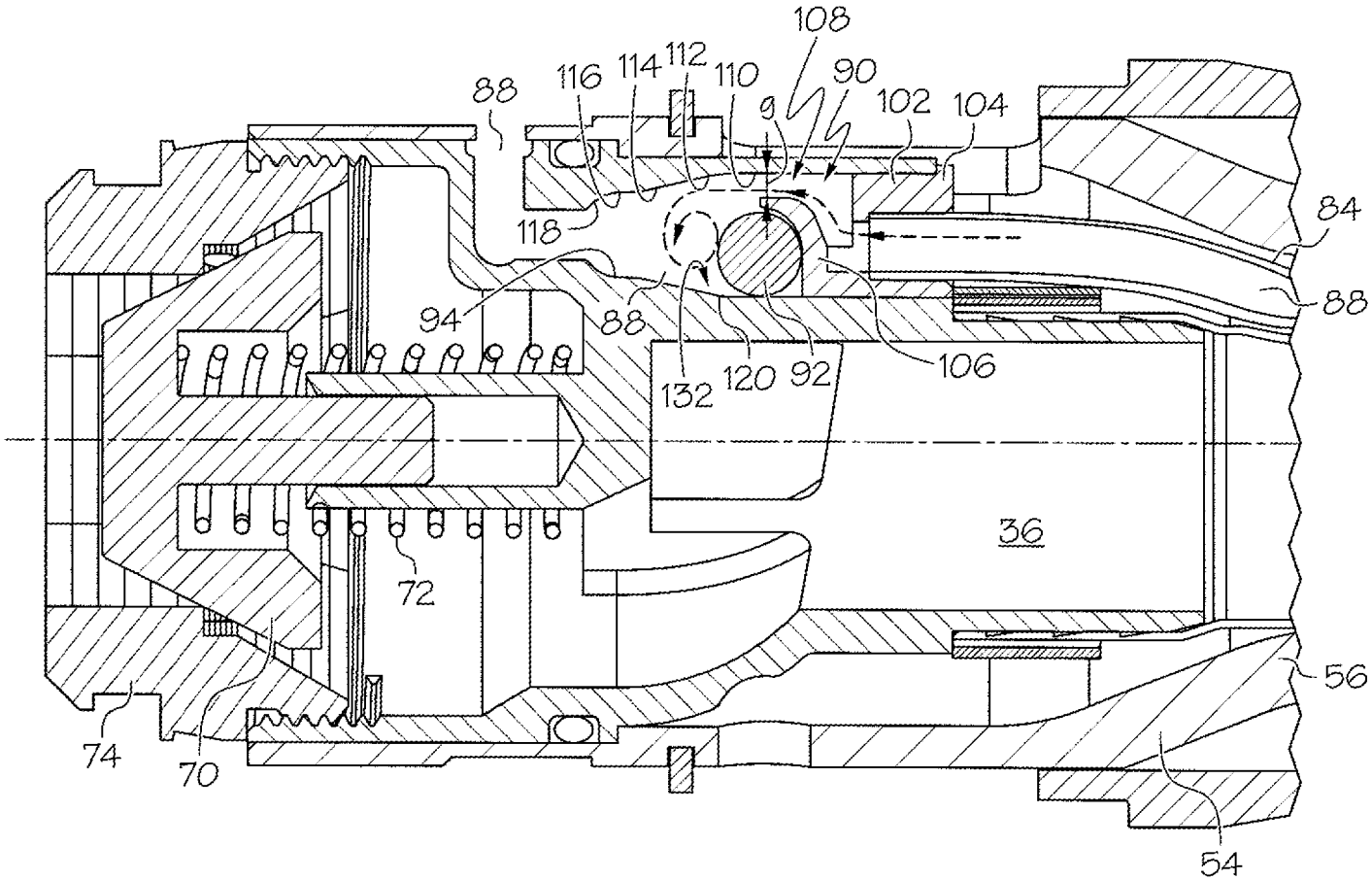
FIG. 4 is a detail view of the base of the spout and spout adapter of FIG. 3, showing the attitude ball in a first or retracted position.

The attitude sensing device 90 includes a spherical ball 92 received on or in a track 94 and freely movable (i.e. by rolling) on the track 94. When the end portion of the nozzle 18 is pointed sufficiently downwardly, the ball 92 generally resides in its retracted, or open, position as shown in FIG. 4. The sensing device 90 may include a shielding plug 102 having a generally cylindrical portion 104 and a deflector portion 106. The generally cylindrical portion 104 slidably fits over the upstream end of the tube 84 to retain the shielding plug 102 in place. In the illustrated embodiment, the deflector portion 106 is generally curved or arcuate in side view, forming a 90° arc in the illustrated embodiment, spanning the sensing path 88 and defining a restricted orifice 108 therein.

As shown in FIG. 4, when the ball 92 is in its retracted position, the ball is positioned immediately adjacent to the deflector portion 106, and the deflector portion 106 extends over and around about the upper upstream quarter of the ball 92, leaving the downstream half uncovered. However, the deflector portion 106 can have any of a wide variety of shapes and configurations beyond that specifically shown herein.

During dispensing operations, incoming air in the sensing path 88 (created by the venturi described above) impinges upon the deflector portion 106 and is deflected upwardly and through the restricted orifice 108 before entering a relatively un-restricted area downstream of the deflector portion 106. The fluid dynamics in this area of the sensing path 88, along with the presence of the ball 92, creates eddy currents just upstream of the deflector portion 106/ball 92, as schematically shown by the dotted line path in FIG. 4. The eddy currents impinge upon, or interact with, the ball 92, forcing the ball 92 upstream and tight against the deflector portion 106, or at least keeping the ball 92 in place. In this manner, the eddy current helps to retain the deflector ball 92 in its retracted position, at least until it is desired for the ball 92 to move to its blocking position, as will be described in greater detail below. Thus, rather than merely shielding the ball from the incoming flow, the deflector portion 106 also helps to positively retain the ball 92 in place.

The restricted orifice 108 may have a surface area of between about ¼ and about 1/10 of the surface area of the portions of the sensing path 88 located immediately upstream and/or downstream of the restriction 108/shielding plug 102. If the surface area of the restricted orifice 108 is too small, the flow becomes choked. On the other hand, if the surface area of the restricted orifice 108 is too large, the desired eddy currents are not formed. In the illustrated embodiment the gap g defined by the restricted orifice 108 is of relatively small height, such as about 1/16" in one embodiment, and can vary between about ⅛" and 1/32" in this embodiment, or between about ⅓ and about 1/10 of the diameter/height of the sensing path 88.

The track 94 may include various different shapes along its length. In particular, the track 94 may include a first or upstream cylindrical portion 110, which is generally flat or cylindrical, a first or upstream conical portion or ramp 112, a second or downstream conical portion or ramp 114, a second or downstream cylindrical portion 116 and a can, seat or pocket 118. In the illustrated embodiment, the pocket 118 is generally spherical (for the sake of clarity it should be understood that "spherical" as used herein can mean a portion or partial surface of a sphere).

The ball 92 may rest upon the upstream cylindrical portion 110 when the ball 92 is in its retracted position, adjacent to the deflector 106. The upstream conical portion 112 may have a relatively shallow internal angle, such as between about 3° and about 10° (about 7° in the illustrated embodiment), and extend for a relatively short length (i.e. about ⅛ of the length of the downstream conical portion 114 in one case). The downstream conical portion 114 may include a sharper, larger angle, such as between about 10° and about 20° (about 15° in the illustrated embodiment). It is noted that the ramps 112, 114 present an incline to the ball 92 as the ball 92 rolls within the track 94. When the ramps 112, 114 are defined by conical sections, as in the illustrated embodiment, the ramps 112, 114 provide the desired incline regardless of the rotation/orientation of the nozzle 18/attitude device 90. The downstream cylindrical portion 116 is positioned between the downstream conical portion 114 and the spherical pocket 118.

The spherical pocket 118 may have a size and shape generally matching that of the ball 92. For example, in one case the pocket 118 has a radius that is within about 5% of the radius of the ball 92 in one case (within about 10% in another case) to provide the desired suction forces as outlined in greater detail below. However, at least one of the size or shape of the pocket 118 may be at least slightly mis-matched with respect to the ball 92 to ensure that the ball 92 does not become fully seated in the pocket 118 to avoid the ball 92 becoming wedged in the pocket 118.

FIG. 4 illustrates the attitude sensing device 90 wherein the end of the nozzle 18 is pointed downwardly and vapor/air flows through the sensing path 88. In this case, as noted above, eddy currents help to retain the ball 92 in place. In addition, the ball 92 and track 94 are configured such that the junction 120 between the flat cylindrical portion 110 and the upstream conical portion 112 is positioned immediately adjacent to the point of contact between the ball 92 and the track 94 when the ball 92 is in its retracted position. Thus, the junction 120 presents a further impediment to the ball 92 rolling downstream. The combination of the eddy current and the junction 120 enable a user of the nozzle 18 to fill shallow angle containers, or utilize the nozzle 18 with fill pipes 38 having shallow angles, without having undesired shut-offs.

Figure 5:
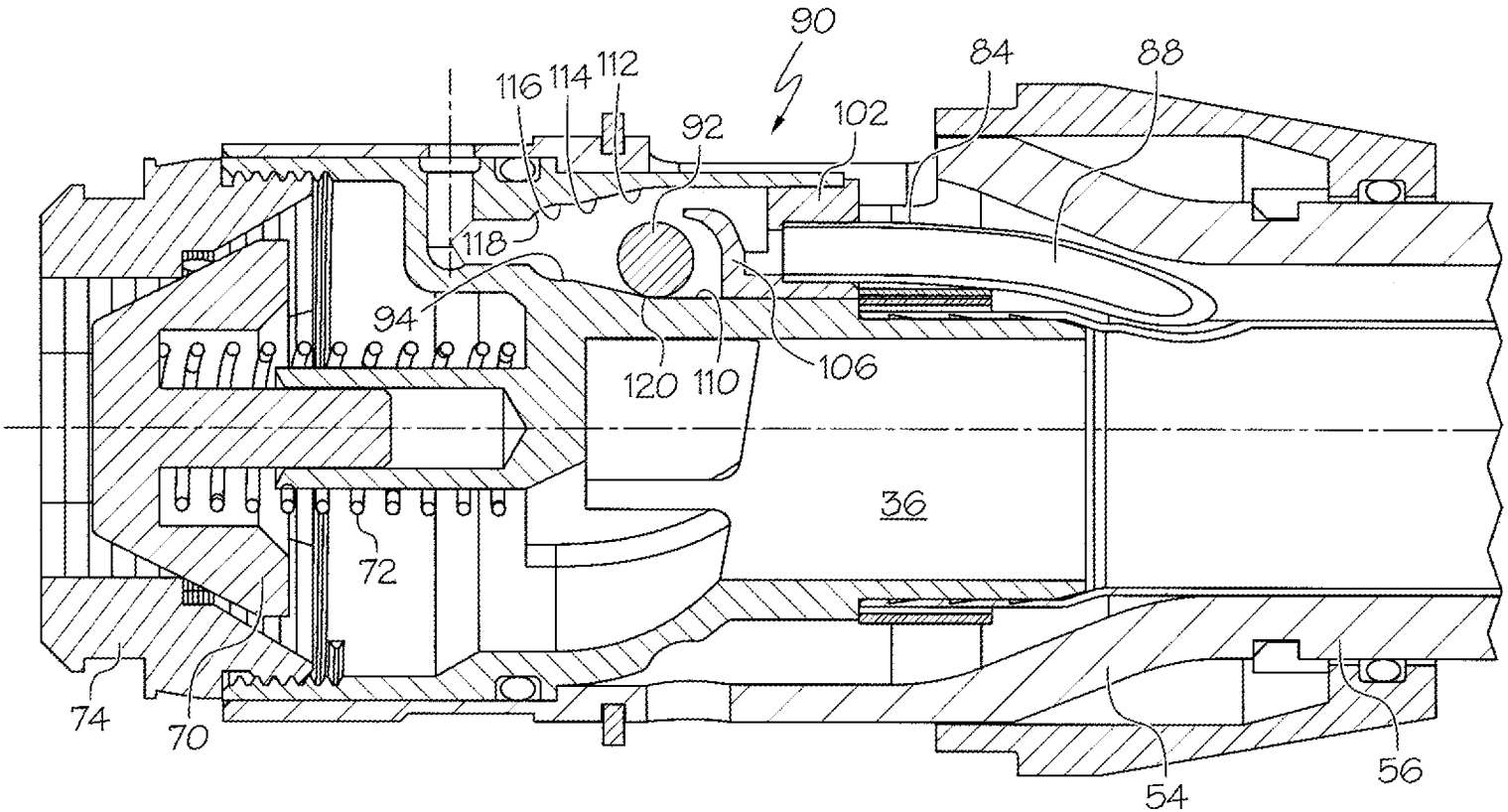
FIG. 5 is a detail view of the spout and spout adapter of FIG. 3, showing the attitude ball in a second position.

The angle of the upstream ramp portion 112 may be smaller than the angle C (FIG. 2) that the end portion 58 of the spout 54 forms relative to the base portion 56. For example, in one embodiment the upstream ramp portion 112 has an angle of about 7 degrees, and the angle C is about 22.5 degrees. In this case, when the end portion 58 is at an angle of about 15.5 degrees below horizontal, any further raising of the spout 54 will cause gravity to begin acting upon the ball 92 to urge the ball 92 away from the retracted position. However, the eddy currents, the junction 120, and friction forces may keep the ball 92 in place. As the spout 54 is raised further, the force of gravity upon the ball 92 eventually overcomes the eddy currents and the retaining force of the junction 120 such that the ball 92 moves away from the retracted position to arrive at the upstream ramp portion 112, as shown in FIG. 5.

In one particular embodiment, the attitude sensing device 90 is configured such that the ball 92 rolls onto the upstream ramp portion 112 once the end portion 58 is raised above horizontal. In another embodiment, the attitude sensing device 90 is configured such that the ball 92 rolls onto the upstream ramp portion 112 once the end portion 58 is below, but approaching, horizontal based upon anticipation that the end portion 58 will continue to be raised, to provide a quick response time.

Figure 6:
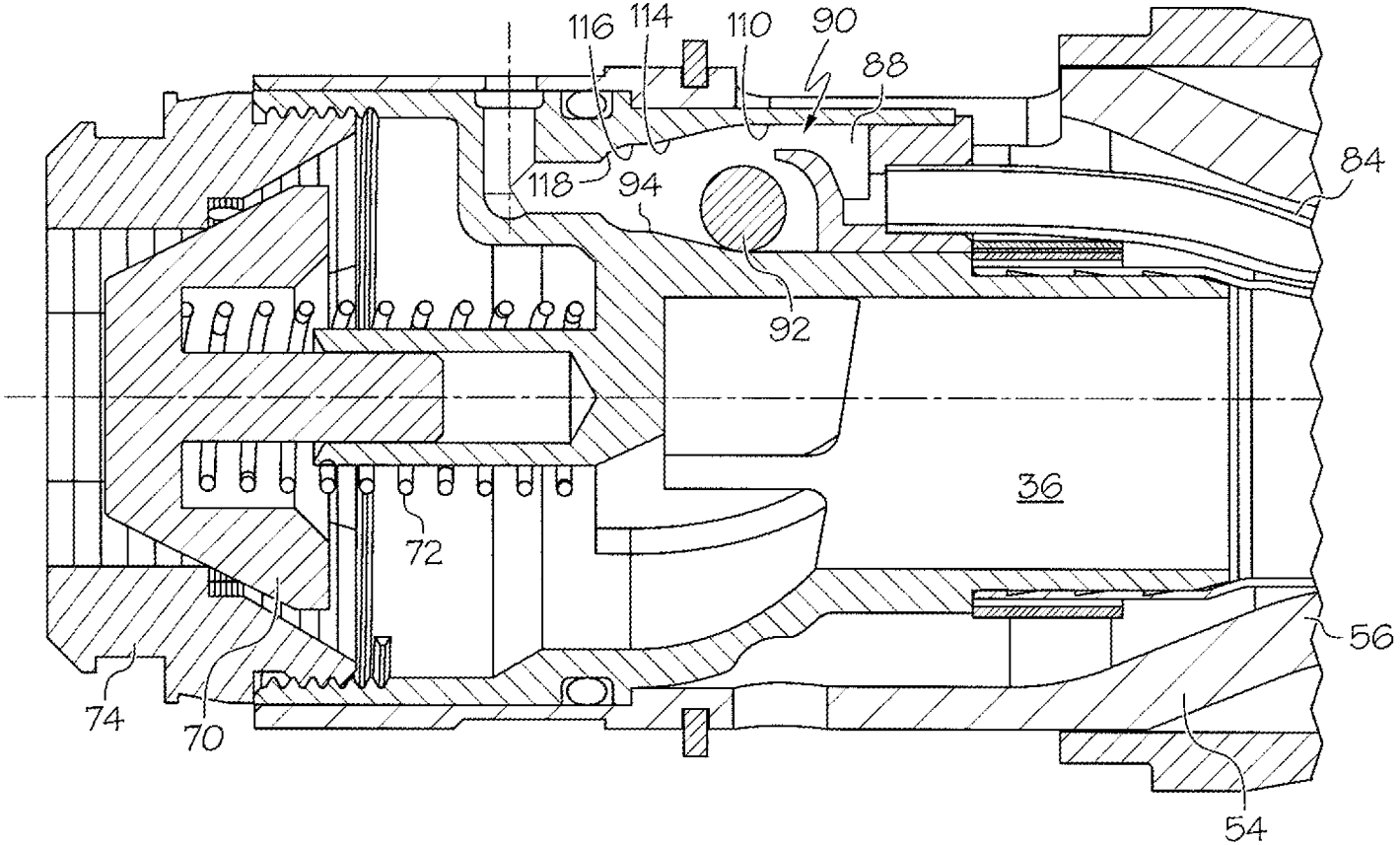
FIG. 6 is a detail view of the spout and spout adapter of FIG. 3, showing the attitude ball in a third position.

Once the ball 92 arrives at the upstream ramp portion 112, it should typically have enough momentum and/or gravity forces acting upon it to roll onto the downstream ramp portion 114, as shown in FIG. 6. The shallow nature of the upstream ramp portion 112 helps to gently guide the ball 92 to the sharper downstream ramp portion 114. However, the upstream ramp 112 may present a sufficiently shallow angle that the junction 120 does not present too serious a restriction to the ball 92 moving away from the refracted position.

Figure 7:
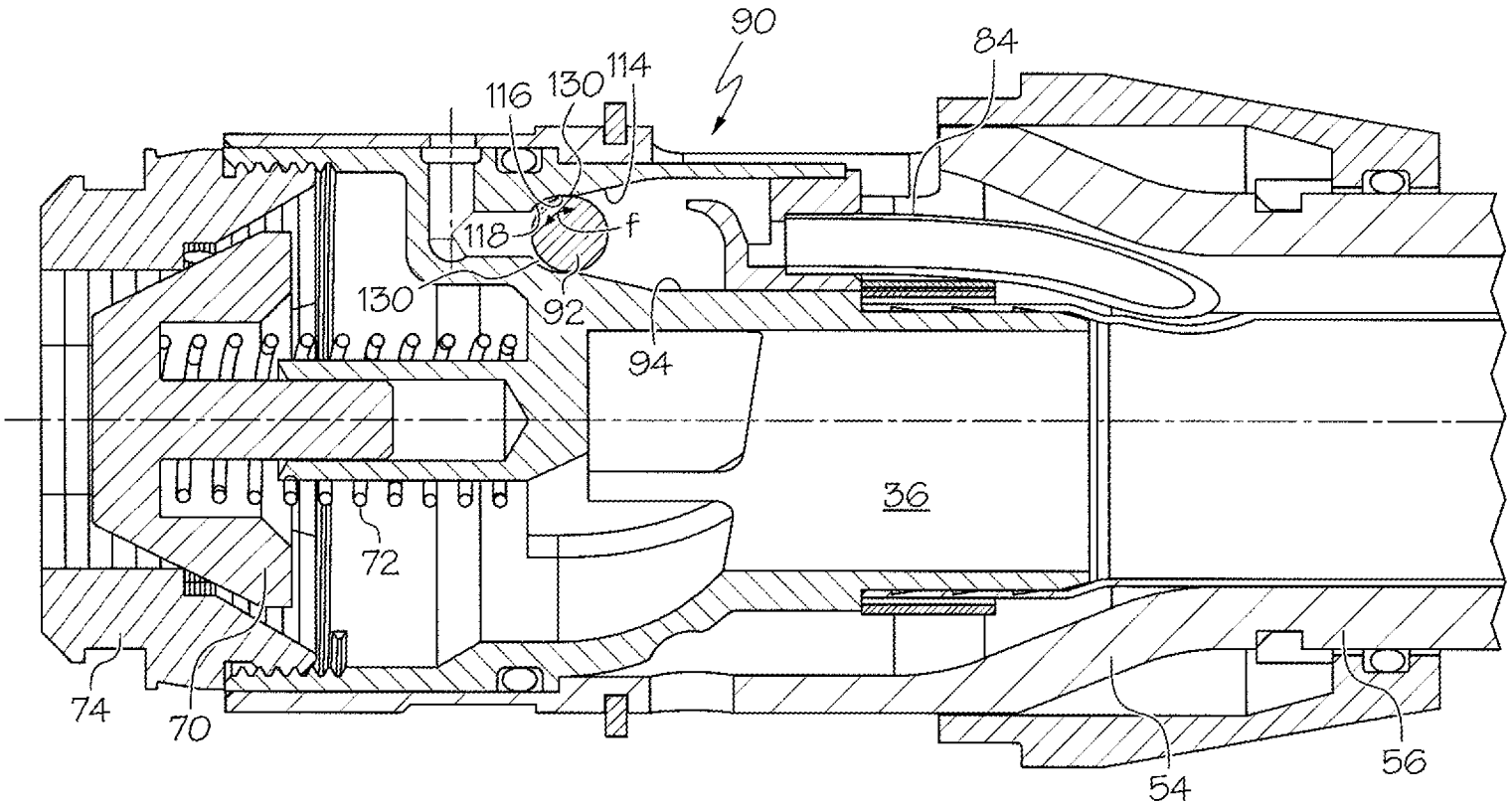
FIG. 7 is a detail view of the spout and spout adapter of FIG. 3, showing the attitude ball in a fourth position.

As the ball 92 continues to move downstream, the upper downstream quadrant of the ball begins to approach, and aerodynamically interact, with the spherical pocket 118. In particular, as shown in FIG. 7, as the ball 92 approaches the pocket 118 and/or downstream cylindrical portion 116, a generally restricted pathway 130 is defined between the upper left surface of the ball 92 (in the orientation shown in the drawings) and the pocket 118/portion 116. Due to the scale of FIG. 7 the restricted pathway 130 at the top surface of the ball 92 is not necessarily visible but in general a gap would be present there.

Air is accelerated through the restricted pathway 130, creating a suction force across the upper downstream portion of the ball, thereby rapidly "pulling" the ball 92 into its blocking position. The cylindrical portion 116 extends for a relatively short length but aids in the development of the suction forces over the ball 92. The restricted pathway 130 is generally spherical as the ball 92 approaches the pocket 118. It has been observed that once the ball 92 is positioned on the downstream ramp portion 114, movement of the ball 92 to its blocking position is due almost entirely to the high suction forces created by the restricted pathway 130, and movement of the ball 92 is not necessarily gravity-dependent. It has also been observed that the ball 92 rapidly moves to its blocking position once the ball 92 enters the downstream ramp portion 114, thereby providing a highly-responsive attitude device.

The restricted pathway 130, and the associated suction force, may act upon the face portion f of the ball shown in FIG. 7, which may extend along the outer surface of the ball 92 between at least about 15° and about 45° in one case, and more particularly at least about 30°. The significant surface of suction acting upon the face f of the ball 92 is to be contrasted with, for example, a conical seat in which only a point (or circumferential line) of suction is provided about the ball 92, which provides a much lower suction force. In addition, when a conical seat is utilized, if there is any debris in the conical portion, or the conical portion and/or ball is distorted (such as by manufacturing irregularities), the suction effect is lost. In contrast, when using a spherical pocket 118, the significantly increased cooperation and greatly lengthened path of constriction 130 generated between the ball 92 and the pocket 118 provides higher suction forces which are able to more easily accommodate debris and manufacturing irregularities.

Moreover, because of the longer development of the vacuum over the face f, incoming air continues to accelerate over the ball 92, increasing the vacuum and raising the pressure to atmospheric on the downstream side of the ball 92. In addition, as the ball 92 approaches the pocket 118, the restriction 130 creates higher pressures upstream of the ball 92, thereby pushing the ball 92 in place. Thus, as the ball 92 approaches the blocking position, it experiences a push/pull effect which amplifies the response time of the attitude sensing device.

Figure 8:
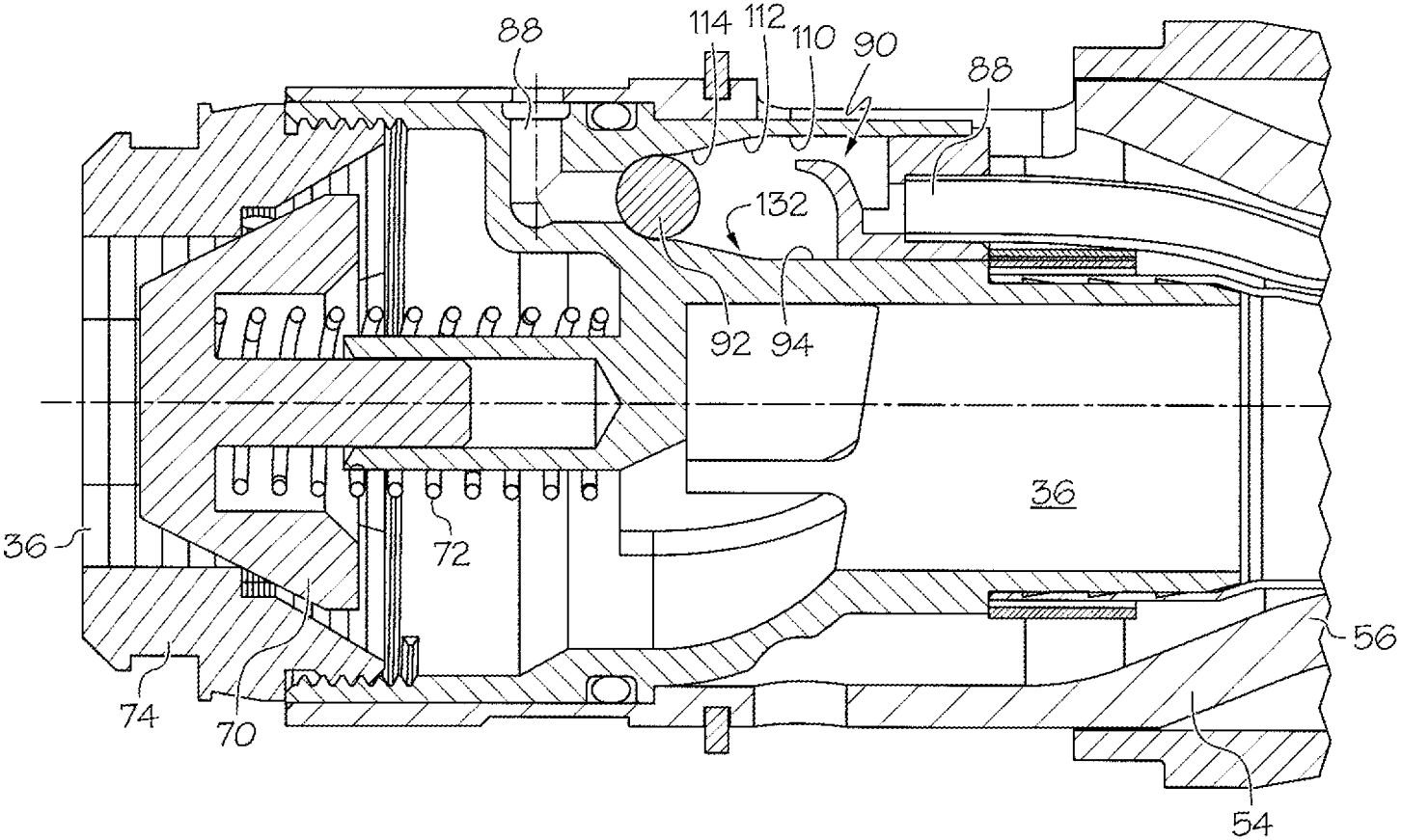
FIG. 8 is a detail view of the spout and spout adapter of FIG. 3, showing the attitude ball in a fifth or blocking position.

When the ball 92 is in its blocking position (as shown in FIG. 8), the sensing path 88 is blocked, and the attitude sensing device 90 prevents air from being drawn through the tube 84 and sensing path 88. This blockage thereby causes a decrease in pressure in the annular chamber 76 (FIG. 2), and accordingly the pressure in the central chamber 80 of the shut-off device 82 decreases significantly.

The decrease in pressure in the central chamber 80 of the shut-off device 82 causes a lower diaphragm 96 of the valve 82 to be raised, pulling a pin 98 upwardly, thereby enabling an associated plunger 100 to move downwardly. The plunger 100 then moves downwardly, urged by the spring forces of the main fluid valve 60 and main vapor valve 62, causing the lever 66 to move and the main fluid and main vapor valves 60, 62 to close. Thus, sufficiently low pressure in the sensing path 88 (such as blockage created by the ball 92 in combination with the generated venturi) causes the shut-off device 82 to close the main valves 60, 62. This interaction between the pin 98 and the plunger 100 is shown and described in more detail in U.S. Pat. No. 2,582,195 to Duerr, the entire contents of which are incorporated herein by reference. Moreover, the operation of the shut-off device 82 described herein is similar in some respects to that of U.S. Pat. No. 4,453,578 to Wilder, the entire contents of which are hereby incorporated by reference. In this manner, the attitude sensing device 90 provides a safety feature in which the nozzle 18 can only operate when it is pointing in the desired orientation.

It should also be understood that the opening 86 at the end of the spout 54 could be blocked, such as when fluid levels in the tank 40 during refilling reach a sufficiently high level. In this case, the shut-off device 82 will operate in the same manner as outlined above, causing the main valves 60, 62 to close. Thus the sensing path 88 can also be utilized to sense overfill conditions and shut off the nozzle 18 accordingly. Moreover, it should be understood that any of a wide variety of shut-off devices can be utilized, and the attitude sensing device 90 disclosed herein is not limited to use with any specific shut-off device or system.

Once the nozzle 18 is pointed sufficiently downwardly, the ball 92 returns to its retracted position in which the sensing path 88 is not blocked. In this manner, the nozzle 92 is then ready for further dispensing operations as desired.

The ball track 94 may have a transition area 132 (FIG. 4) positioned between the upstream 112 and the downstream 114 ramps. The transition area 132 is, in one case, defined by a relatively smooth area having a radius. The radius of the transition portion 132 may be equal to or larger than the radius of the ball 92 to provide ease of rolling as the ball 92 rolls from the upstream ramp portion 112 to the downstream ramp portion 114. In particular, if, for example, the transition portion 132 were to have a radius smaller than that of the ball 92, the ball 92 could engage the track 114 at two positions simultaneously as the ball 92 rolls from the upstream 112 to the downstream 114 ramp. In this scenario, the upstream point of contact can act as a brake, causing the ball 92 to hesitate or even stop as it rolls downstream. Thus, if not properly designed, the transition portion 132 can cause the ball 92 to become stuck or hung up which prevents consistent, repeatable performance of the attitude sensing device 90. In contrast, by forming the transition portion 132 of a surface having a radius larger than that of the ball 92, it can be ensured that the ball 92 engages the track 94 at only a single point of rolling contact as the ball 92 moves from the retracted position to the blocking position, providing consistent, repeatable performance.

Thus, the deflector portion 106, in combination with the two-stage ramps 112, 114, the spherical pocket 118 and other features described herein provide consistent, repeatable and precise operation of the attitude sensing device 90. In particular, during operation the eddy currents and the upstream ramp 112 portion help to keep the ball 92 in the retracted position, when appropriate, thereby preventing premature shut-offs of the nozzle 18. In contrast, once the nozzle 18 is raised to a sufficient angle/attitude, the ball 92 overcomes the retaining forces of the eddy currents and/or upstream ramp portion 112. Once the ball 92 enters or approaches the downstream ramp portion 114, the ball 92 rapidly rolls and/or is sucked or pushed to the blocked position, thereby providing precise shut-off control. The spherical design of the pocket 118 provides a constricted pathway 130 about a significant portion of the outer face of the ball 92 to provide the suction forces and benefits described above.

Having described the invention in detail and by reference to the various embodiments, it should be understood that modifications and variations thereof are possible without departing from the scope of the invention.

What is claimed is:

1. A nozzle comprising:

a dispensing path configured such that fluid is dispensable therethrough and into a vessel;

a sensing path in which a negative pressure is generated when fluid flows through said dispensing path;

an attitude sensing device configured to sense an attitude of said nozzle, said attitude sensing device being in fluid communication with said sensing path and including a ball received in a track, said track including a generally spherical portion configured to receive said ball therein to generally block said sensing path when said nozzle is raised to a sufficient angle, wherein said spherical portion has a radius generally corresponding to a radius of said ball; and a shut-off device operatively coupled to said attitude sensing device such that when said sensing path is blocked by said ball said shut-off device moves to a closed position to generally block said nozzle from dispensing fluid through said dispensing path.

2. The nozzle of claim 1 wherein said spherical portion and said ball have generally the same size and shape such that a generally spherical restricted pathway is defined between said ball and said spherical portion as said ball approaches said generally spherical portion.

3. The nozzle of claim 1 wherein said spherical portion is defined by a radius that is within at least about 10% of a radius of said ball.

4. The nozzle of claim 1 wherein said track includes an angled portion positioned upstream relative to said spherical portion.

5. The nozzle of claim 4 wherein said track includes a supplemental angled portion positioned upstream relative to said angled portion, wherein said angled portion presents a sharper angle to said ball than said supplemental angled portion.

6. The nozzle of claim 5 further comprising a generally curved transition area between said angled portion and said supplemental angled portion, wherein said transition area is defined by a radius equal to or larger than a radius of said ball.

7. The nozzle of claim 4 wherein said track includes a generally cylindrical portion positioned between said angled portion and said spherical portion.

8. The nozzle of claim 1 wherein said attitude sensing device includes a deflector positioned upstream of said generally spherical portion, wherein said deflector is configured to generate an eddy current when fluid flows through said sensing path to thereby retain said ball in a position adjacent to said deflector.

9. The nozzle of claim 8 wherein said deflector defines a restriction in said sensing path having a surface area of between about ¼ and about 1/10 of the surface area of portions of said sensing path located immediately upstream or downstream of said restriction.

10. The nozzle of claim 8 wherein said track includes an angled ramp and a straight portion defining a junction therebetween, wherein said junction is positioned adjacent to said deflector such that a point of contact between said ball and said track is positioned adjacent to said junction when said ball is positioned adjacent to deflector.

11. The nozzle of claim 1 wherein said ball and said spherical portion are at least slightly mismatched in shape or size to avoid said ball becoming fully seated in said spherical portion.

12. The nozzle of claim 1 wherein said shut-off device includes a diaphragm exposed on one side to a pressure in said sensing path, and wherein said diaphragm is configured such that when said ball generally blocks said sensing path during dispensing operations the pressure on said one side of said diaphragm decreases, causing said diaphragm to move, which in turn causes a main shut-off valve positioned in said dispensing path to move to a closed position.

13. The nozzle of claim 1 wherein said nozzle includes a spout defining, at least part of said dispensing path, and wherein said spout receives a tube therein defining at least part of said sensing path, said tube including an opening positioned at or adjacent to an end of said spout in fluid communication with said tube, wherein said attitude sensing device axially overlaps with said spout such that said attitude sensing device is positioned in a radial place that intersects said spout and said attitude sensing device.

14. The nozzle of claim 1 further comprising a poppet valve positioned in said dispensing path such that when fluid of a sufficient pressure flows through said dispensing path said poppet valve is opened such that said dispensed fluid creates a negative pressure in said sensing path by a venturi effect.

15. The nozzle of claim 1 wherein said nozzle includes a base portion and an end portion positioned at an angle relative to said base portion, wherein the end portion includes a tip of the spout, and wherein said attitude sensing device is positioned in said base portion.

16. A method for operating a nozzle comprising:

accessing a nozzle having a dispensing path, a sensing path, and an attitude sensing device in communication with a shut-off device, said attitude sensing device being in fluid communication with said sensing path and including a ball received in a track, said track including a generally spherical portion having a radius closely generally corresponding to a radius of said ball, said generally spherical portion defining a socket with a concave surface;

causing fluid to be dispensed through said dispensing path which generates a negative pressure in said sensing path; and raising said nozzle to a sufficient angle such that said ball rolls towards and is received in said socket to generally block said sensing path and trigger said shut-off device.

17. The nozzle of claim 1 further comprising a vapor path configured to capture vapors expelled from the vessel when fluid is dispensed therein and route said vapors to a storage tank, wherein said vapor path is fluidly isolated from said sensing path and said dispensing path.

18. The nozzle of claim 1 further comprising a negative pressure generator carried on said nozzle and positioned in said dispensing path such that when fluid of a sufficient pressure flows through said dispensing path said negative pressure generator creates a negative pressure in said sensing path.

19. A nozzle comprising:

a dispensing path configured such that fluid is dispensable therethrough and into a vessel;

a sensing path in which a negative pressure is generated when fluid flows through said dispensing path; and an attitude sensing device configured to sense an attitude of said nozzle, said attitude sensing device being in fluid communication with said sensing path and including a ball received in a track, said attitude sensing device including a deflector configured to generate an eddy current when fluid flows through said sensing path to thereby retain said ball in a position adjacent to said deflector when said nozzle is at sufficiently low angles relative to horizontal.

20. The nozzle of claim 19 wherein said track includes a generally spherical portion configured to receive said ball therein to generally block said sensing path when said nozzle is raised to a sufficient angle.

21. The nozzle of claim 19 wherein said track further includes a seat configured to receive said ball therein to generally block said sensing path when said nozzle is raised to a sufficient angle, wherein said track further includes a first angled portion and a second angled portion, wherein said second angled portion presents a sharper angle to said ball than said first angled portion and is positioned between said first angled portion and said seat.

22. The nozzle of claim 19 further comprising fluid flowing through said sensing path and interacting with said deflector such that said deflector generates said eddy current in said fluid which retains said ball against said deflector.

23. A nozzle comprising:

a dispensing path configured such that fluid is dispensable therethrough and into a vessel;

a sensing path in which a negative pressure is generated when fluid flows through said dispensing path; and an attitude sensing device configured to sense an attitude of said nozzle, said attitude sensing device being in fluid communication with said sensing path and including a ball received in a track and rollable thereon, said track including a seat configured to receive said ball therein to generally block said sensing path when said nozzle is raised to a sufficient angle, wherein said ball and track are configured such that said ball engages said track at only a single point of rolling contact as the ball moves therealong.

24. The nozzle of claim 23 wherein said seat has a generally spherical surface.

25. The nozzle of claim 23 wherein said attitude sensing device includes a deflector configured to generate eddy currents when fluid flows through said sensing path to thereby retain said ball in a position adjacent to said deflector.

26. The nozzle of claim 23 wherein said track further includes a first angled portion and a second angled portion, wherein said second angled portion presents a sharper angle to said ball than said first angled portion and is positioned between said first angled portion and said seat, and wherein each angled portion is defined by a conical section.

* * * * *